US007465004B2

(12) United States Patent
Ito

(10) Patent No.: US 7,465,004 B2
(45) Date of Patent: Dec. 16, 2008

(54) RECORDING APPARATUS

(75) Inventor: Hirosumi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 302 days.

(21) Appl. No.: 11/060,148

(22) Filed: Feb. 17, 2005

(65) Prior Publication Data

US 2005/0190214 A1 Sep. 1, 2005

(30) Foreign Application Priority Data

Feb. 27, 2004 (JP) ..... 2004-055091

(51) Int. Cl.
*B41J 2/01* (2006.01)

(52) U.S. Cl. ..... 347/12

(58) Field of Classification Search ..... 347/5, 347/9, 12, 20, 40, 41, 42
See application file for complete search history.

(56) References Cited

U.S. PATENT DOCUMENTS

| | | | | |
|---|---|---|---|---|
| 4,914,562 | A | 4/1990 | Abe et al. | |
| 5,889,539 | A * | 3/1999 | Kamoi et al. | 347/50 |
| 6,260,937 | B1 * | 7/2001 | Sugahara | 347/14 |
| 6,281,914 | B1 * | 8/2001 | Hiwada et al. | 347/50 |
| 6,474,789 | B1 * | 11/2002 | Ishinaga et al. | 347/59 |
| 6,540,313 | B2 * | 4/2003 | Suzuki | 347/5 |
| 6,891,314 | B2 * | 5/2005 | Sato et al. | 310/328 |
| 6,986,564 | B2 * | 1/2006 | Matsuo et al. | 347/68 |
| 7,055,922 | B2 * | 6/2006 | Ikeda et al. | 347/10 |
| 7,055,936 | B2 * | 6/2006 | Imai et al. | 347/58 |
| 2002/0003557 | A1 | 1/2002 | Miyakoshi et al. | |
| 2003/0063449 | A1 | 4/2003 | Suzuki et al. | |
| 2003/0122885 | A1 | 7/2003 | Kobayashi | |
| 2004/0036724 | A1 | 2/2004 | Masuda et al. | |
| 2005/0174368 | A1 * | 8/2005 | Suzuki | 347/5 |

FOREIGN PATENT DOCUMENTS

| | | |
|---|---|---|
| EP | 1 142 714 A1 | 10/2001 |
| JP | A-2000-85116 | 3/2000 |
| JP | A-2002-234171 | 8/2002 |
| JP | A-2003-80683 | 3/2003 |

* cited by examiner

*Primary Examiner*—Huan H Tran
(74) *Attorney, Agent, or Firm*—Reed Smith LLP

(57) ABSTRACT

A recording apparatus for performing a recording operation on a recording medium on the basis of recording information. The apparatus including: (a) a recording head having (a-i) recording elements arranged in a plurality of rows, and (a-ii) drive electrodes arranged in a plurality of rows and receiving respective drive signals to drive the respective recording elements; (b) a converter converting serially transmitted data representative of the recording information, into parallel signals serving as the drive signals applied to the drive electrodes; and (c) a controller which transmits the data serially to the converter. The converter has a plurality of output terminals which are connected to the respective drive electrodes across the plurality of rows of the drive electrodes, and are arranged in a row in an order generally corresponding to arrangement of the drive electrodes from one end of the recording head to the other end thereof. The controller transmits the data representative of the recording information to the converter serially in association with the drive electrodes, in an order corresponding to arrangement of the output terminals.

11 Claims, 7 Drawing Sheets

RECORDING APPARATUS

This application is based on Japanese Patent Application No. 2004-055091 filed on Feb. 27, 2004, the content of which is incorporated hereinto by reference.

BACKGROUND OF THE INVENTION

1. Field of the Invention

The present invention relates in general to a recording apparatus, and more particularly to a recording apparatus which has recording elements arranged in a plurality of rows and which is arranged to perform a recording operation by driving the recording elements on the basis of recording information supplied to the apparatus.

2. Discussion of Related Art

As disclosed in U.S. Patent Application Publication No. US 2003/0063449 A1 (corresponding to JP-A-2003-80683), the recording head of an inkjet recording apparatus is equipped with a plate-type piezoelectric actuator unit having recording elements which are activated to eject color inks through nozzles. That is, each of the recording elements is activated to eject the ink of the corresponding color through a corresponding one of the nozzles which are formed in the recording head to be arranged in a plurality of rows. On a surface of the piezoelectric actuator unit, there are formed surface electrodes which are electrically connected to drive electrodes, so that drive signals driving the respective recording elements can be supplied to the drive electrodes via the surface electrodes. A flexible wiring board is provided to be connected to an upper portion of the piezoelectric actuator unit, such that the wiring board is elongated or extends in a direction parallel to the rows of the nozzles. On the flexible wiring board, there is disposed an IC chip (hereinafter referred to as "converter") for outputting the drive signals. The converter has output terminals connected to the respective surface electrodes via a wiring pattern which is formed on the flexible wiring board and which is provided by conductive lines or wires each connecting a corresponding one of the output terminals to a corresponding one of the surface electrodes. The conductive wires are arranged to extend substantially straightly in parallel with the rows of the nozzles. In this arrangement, the output terminals and the conductive wires are grouped into a plurality of groups corresponding to the respective rows of the nozzles.

Meanwhile, U.S. Pat. No. 6,260,937 (corresponding to JP-A-2000-85116) discloses a control to transmit recording information to the converter, which control can be carried out in a recording apparatus such as the above-described inkjet recording apparatus. According to the disclosure of this U.S. Patent, the inkjet recording apparatus has image-data buffer storages each capable of storing a portion of the recording information which is related to a corresponding one of the ink colors. The image-data buffer storages are connected to respective read-out circuits. When a recording operation is performed on a recording medium, the recording information is read out, by CPU command, from the buffer storages via the read-out circuits, and is then serially transmitted to the converter. In the serial transmission of the information, the portions of the recording information relating to the respective ink colors are transmitted in sequence over a single path to the converter. The converter coverts the serially transmitted information into parallel signals, and then applies the parallel signals as drive signals to the respective drive electrodes, so that the inks are ejected through the respective nozzles onto the recording medium whereby the recording operation is performed on the recording medium.

However, in the above-described inkjet recording apparatus in which the flexible wiring board is elongated in the direction parallel to the rows of the nozzles, a widthwise direction of the wiring board corresponds to a direction perpendicular to the rows of the nozzles, namely, corresponds to a widthwise direction of the recording head rather than a lengthwise direction of the recording head. Therefore, there is a limitation as to the number of the conductive wires formable on the wiring board, making it difficult to increase the number of the nozzles. Where the number of the nozzles is required to be increased, the recording apparatus requires to be provided with a plurality of recording heads. The provision of the plurality of recording heads problematically leads to an increase in cost required for manufacturing the apparatus and an increase in overall size of the apparatus.

Such problems could be solved by an arrangement in which the flexible wiring board is connected to the recording head such that the wiring board is elongated in the direction perpendicular to the rows of the nozzles, namely, such that the wiring board can be given a width as large as the lengthwise dimension of the recording head. However, for enabling the recording apparatus with this arrangement, to perform a recording operation under the above-described control, since each family of the output terminals associated with a corresponding one of the recording colors is constituted by ones of the output terminals which are adjacent to each other, the adjacent output terminals constituting each family of the output terminals have to be necessarily connected to ones of the surface electrodes located in a corresponding one of the rows. To this end, (i) the flexible wiring board has to be arranged to have a plurality of layers so that the output terminals of each family can be connected to the surface electrodes of the corresponding row via one of a plurality of wiring patterns which are formed on the respective layers, or (ii) a logic circuit has to be provided within the converter or between the output terminals and the surface electrodes, for changing a positional relationship between each of the output terminals and a corresponding one of the surface electrodes. In either of these arrangements, the manufacturing cost is inevitably increased.

SUMMARY OF THE INVENTION

The present invention was made in view of the background prior art discussed above. It is therefore an object of the invention to provide a recording apparatus which has recording elements arranged in a plurality of rows and which has simplified circuit and wiring arrangements for transmission of recording information. The object may be achieved according to the principle of the invention, which provides a recording apparatus for performing a recording operation on a recording medium on the basis of recording information. This recording apparatus includes: (a) a recording head having (a-i) recording elements which are arranged in a plurality of rows, and (a-ii) drive electrodes which are arranged in a plurality of rows and which receive respective drive signals to drive the respective recording elements; (b) a converter which converts serially transmitted data representative of the recording information, into parallel signals serving as the drive signals applied to the drive electrodes; and (c) a controller which transmits the data serially to the converter. The converter has a plurality of output terminals which are connected to the respective drive electrodes arranged in the plurality of rows, so that the parallel signals can be transmitted to the drive electrodes through the respective output terminals. The output terminals are connected to the respective drive electrodes across the plurality of rows of the drive electrodes, and are arranged in a row in an order generally corresponding to arrangement of the drive electrodes from one end of the recording head to the other end thereof The controller transmits the data representative of the recording information to the converter serially in association with the drive electrodes, in an order corresponding to arrangement of the output terminals.

In the recording apparatus according to the principle of the invention, the recording head has the recording elements arranged in the plurality of rows and the drive electrodes arranged in the plurality of rows so as to correspond to the respective recording elements. The drive electrodes receive the respective drive signals to drive the respective recording elements. The converter converts the serially transmitted data into the parallel signals serving as the drive signals applied to the drive electrodes. The output terminals of the converter are connected to the respective electrodes across the plurality of rows of the drive electrodes, and are arranged in the row in the order generally corresponding to the arrangement of the drive electrodes from the one end of the recording head to the other end thereof. Further, the controller transmits the data representative of the recording information to the converter serially in association with the drive electrodes, in the order corresponding to the arrangement of the output terminals. Therefore, the data is serially transmitted by the controller to the converter in the order generally corresponding to the arrangement of the drive electrodes from the one end of the recording head to the other end thereof. The parallel signals, which are obtained from the data thus transmitted, can be applied as the drive signals directly to the drive electrodes. Thus, even where a large number of the output terminals and a large number of the drive electrodes are connected through a wiring board which is elongated in a direction substantially perpendicular to the rows of the drive electrodes, the connections can be made without complicating the wire or circuit arrangement.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

Figure 1:
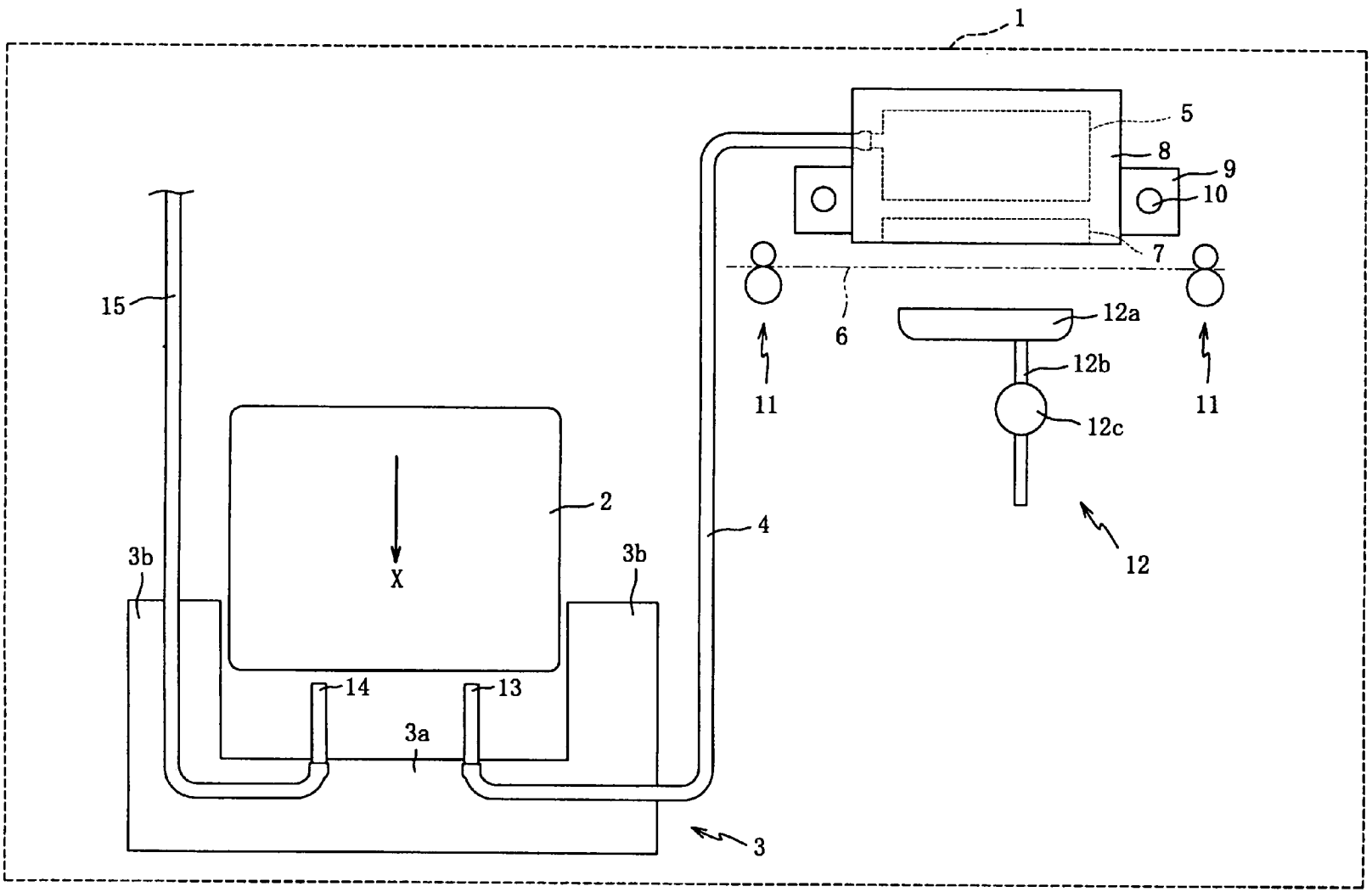
FIG. 1 is a view schematically showing an inkjet recording apparatus which is constructed according to an embodiment of the invention.

Referring first to the schematic view of FIG. 1, there will be described an inkjet recording apparatus in the form of a inkjet printer 1 which includes: ink cartridges 2 filled with respective color inks; mount portions 3 on which the ink cartridges 2 are removably mounted; ink supplying tubes 4; ink tanks 5 for storing the inks supplied from the ink cartridges 2 through the respective ink supplying tubes 4; a recording head 7 for ejecting the inks stored in the ink tanks 5, toward a recording medium (e.g., paper sheet) 6; a carriage 9 for carrying a recording head unit 8 which is principally constituted by the ink tanks 5 and the recording head 7; a pair of guide rods 10 for guiding the carriage 9 which is reciprocated along the guide rods 10; a feed device 11 for feeding the recording medium 6 in a predetermined direction; and a purging device 12.

The ink cartridges 2, containing the respective color inks (e.g., cyan, magenta, yellow and black inks), are provided in the inkjet printer 1, for enabling the printer 1 to perform a full-color printing operation. Each ink cartridge 2 can be mounted in the corresponding mount portion 3, by simply pressing the ink cartridge 2 into the mount portion 3 in a direction as indicated by arrow X as shown in FIG. 1.

Each mount portion 3 has a base portion 3*a* and a pair of guide portions 3*b* which extend from respective opposite end portions of the base portion 3*a*. An ink supplying pipe 13 and an air introducing pipe 14 are provided to be project from the base portion 3*a*, so that the ink stored in the ink cartridge 2 can be supplied to an exterior of the ink cartridge 2 through the ink supplying pipe 13 while an outside air can be introduced into the ink cartridge 2 through the air introducing pipe 14.

The ink supplying pipe 13 is connected at its one end portion to the ink supplying tube 4, so as to be held in communication with the ink tank 5 through the ink supplying tube 4. The air introducing pipe 14 is connected at its one end portion to an air introducing tube 15, so as to be held in communication with outside air through the air introducing tube 15.

The purging device 12 is disposed in a purging operation position located outside a printing area (within which the recording head 7 is moved for achieving the printing operation), and is opposed to the recording head 7 when the recording head 7 is positioned in the purging operation position. The purging device 12 has a purge cap 12*a*, a waste ink tube 12*b* and a pump 12*c*. The purge cap 12*a* is provided to cover a nozzle-defining surface of the recording head 7 in which nozzles 16*k*, 16*c*, 16*y*, 16*m* open (see FIG. 4). The pump 12 is activated to suck poor-quality or waste inks from the nozzles 16*k*, 16*c*, 16*y*, 16*m* through the waste ink tube 12*b* which is held in communication with the purge cap 12*a*.

Figure 2:
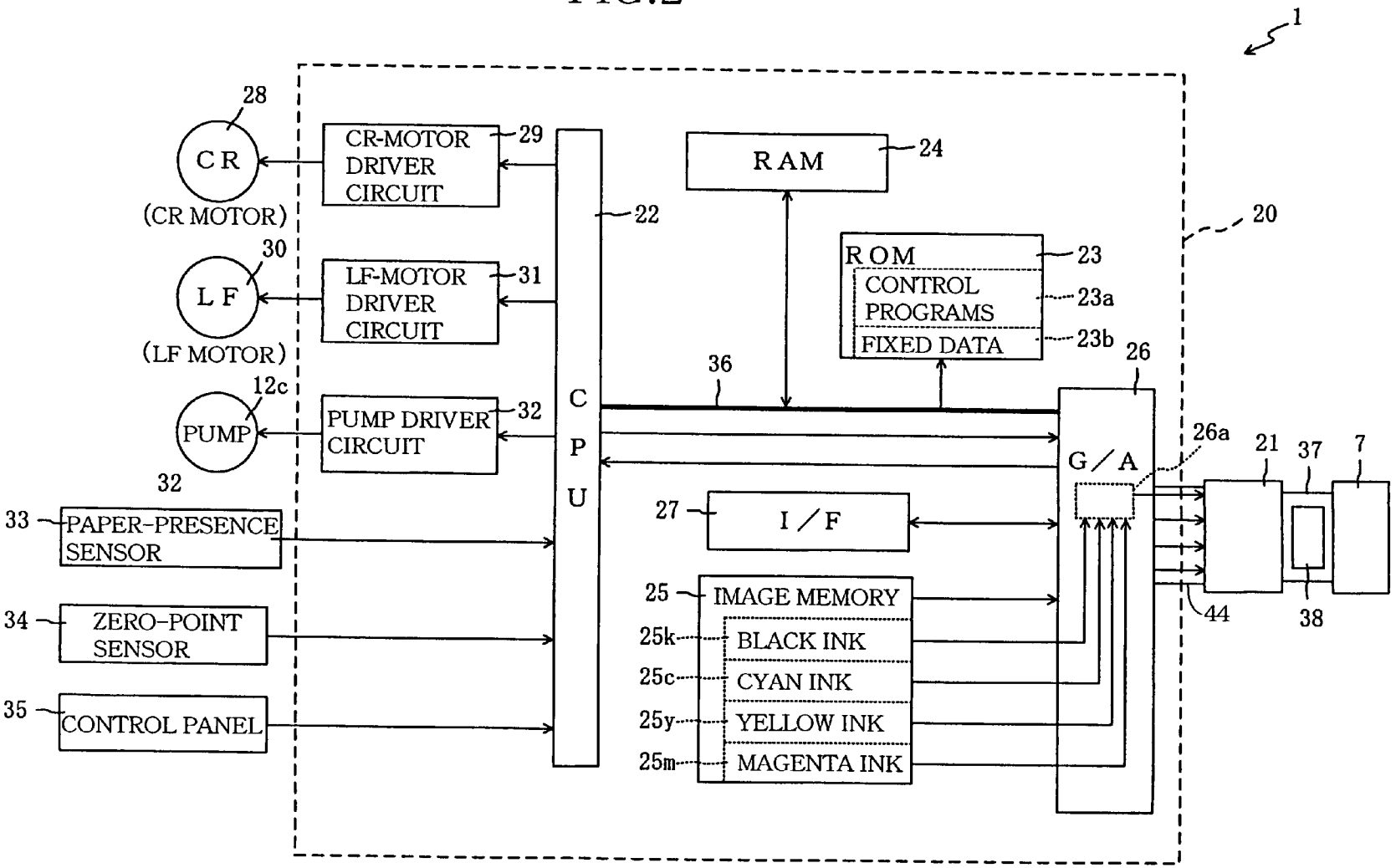
FIG. 2 is a block diagram illustrating an electric circuit arrangement of the inkjet recording apparatus of FIG. 1.

Referring next to a block diagram of FIG. 2, there will be described an electric circuit arrangement of the inkjet printer 1.

The inkjet printer 1 is provided with a control device including a controller board in the form of a main control board 20 mounted on a main body of the inkjet printer 1, and a carriage board 21 mounted on the carriage 9. The main control board 20 incorporates: a CPU (one-chip microcomputer) 22 serving as a main control portion; a ROM 23 storing various control programs 23*a* executed by the CPU 22 and various fixed data 23*b* used by the CPU 22; a RAM 24 provided by a rewritable volatile memory for temporarily storing various data; an image memory 25; a G/A (gate array) 26; and an I/F (interface) 27 through which various data are transmitted between the main control board 20 and an external device such as a host computer (not shown).

The CPU 22 functioning as an arithmetic and logic device is operable to perform various operations according to the control programs 23*a* stored in the ROM 23. The CPU 22 is further operable to generate a printing timing signal and a resetting signal, and apply these signals to the G/A 26. To the CPU 22, there are connected: a CR-motor driver circuit 29 for driving a carriage drive motor (CR motor) 28 to move the carriage 9; a LF-motor driver circuit 31 for driving a sheet feeding motor (LF motor) 30 to feed the recording medium 6; a pump driver circuit 32 for driving the pump 12*c*; a paper-presence sensor 33 for detecting a leading edge of the recording medium 6; a zero-point sensor 34 for confirming that the carriage 9 is positioned in its zero-point (home) when it is returned to the zero-point; and an operator's control panel 35 through which the user enters desired commands (e.g., printing command) into the CPU 22. The various elements thus connected to the CPU 22 are controlled by the CPU 22.

The image memory 25 has a buffer section for temporarily storing recording information transmitted from the external device via the I/F 27. This buffer section includes information storages in the form of image-data buffer storages each storing a portion of the recording information which is related to a corresponding one of the recording ink colors. As the image-data buffer storages, there are a black-color-image-data buffer storage 25*k*, a cyan-color-image-data buffer storage 25*c*, a yellow-color-image-data buffer storage 25*y* and a magenta-color-image-data buffer storage 25*m*.

The G/A 26 serves to cause the image memory 25 to store therein the recording information transmitted from the external device via the I/F 27. Further, the G/A 26 generates a data-reception interruption signal on the basis of data transferred from the host computer or other external device via the I/F 27, and then transfers the generated signal to the CPU 22.

The G/A 26 includes a controller 26*a* which reads out the recording information from the buffer storages 25*k*, 25*c*, 25*y*, 25*m* and serially transmits the recording information to the carriage board 21. The G/A 26 outputs recording data DATA representative of the recording information read out by the controller 26*a*, a transfer clock TCK for synchronization with the recording data DATA, a strobe signal STB, and an ejection timing signal CLK (which is outputted at a predetermined cycle). The outputted data and signals are transmitted through respective signal lines to the carriage board 21 which is equipped with a head driver. Further, a power for driving a converter 38 is supplied to the carriage board 21 through a power line.

The G/A 26 and the carriage board 21 are connected to each other through a flexible wiring board 44, so that the above-described data and signals can be transmitted between the G/A 26 and the carriage board 21 through the flexible wiring board 44. The CPU 22 is connected to the ROM 23, RAM 24 and G/A 26 via a bus line 36.

The carriage board 21 serves as a relay circuit board which connects the main control board 20 and the recording head 7. The carriage board 21 and the recording head 7 are connected to each other through a flexible wiring board 37 which is provided by a polyimide film having a thickness of 50-150 μm and a copper foil wiring pattern formed on the film. On the flexible wiring board 37, there is disposed an IC chip serving as the converter 38 for converting the serially transmitted recording data DATA into parallel signal data, and forming drive signals based on the transmitted data DATA. The converter 38 outputs the drive signals for driving a piezoelectric actuator unit which is described below. It is noted that the flexible wiring board 37 is connected at its end terminals 37*a* with the carriage board 21.

Figure 4:
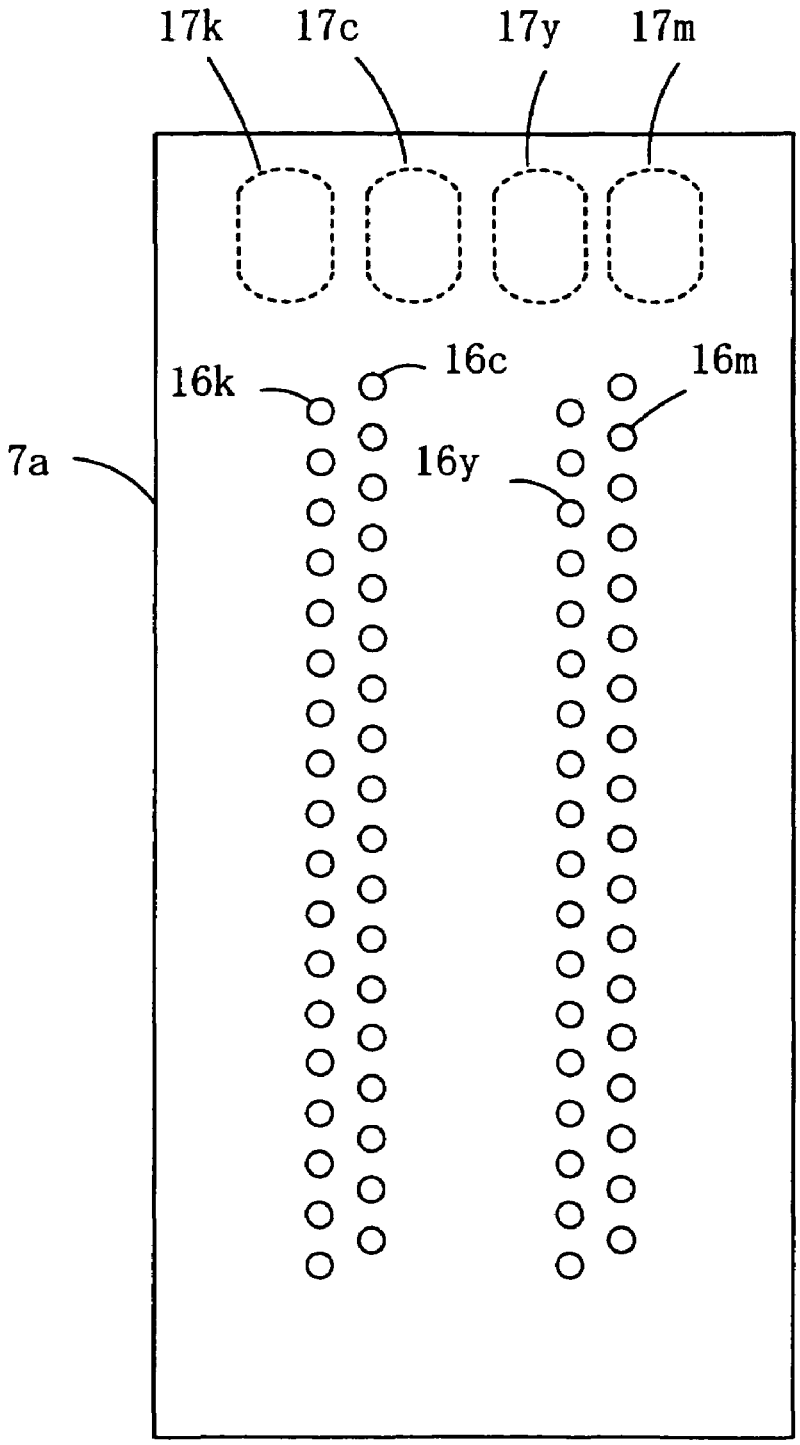
FIG. 4 is a bottom-plan view of the recording head of FIG. 3.

As shown in FIG. 4, on the lower or nozzle-defining surface of the recording head 7 (which surface is to be opposed to the recording medium 6 as shown in FIG. 1), the nozzles 16*k*, 16*c*, 16*y*, 16*m* are arranged in four rows which are parallel with each other. Described specifically, the nozzles 16*k*, through which the black color ink is to be ejected, are located in the leftmost one of the rows, as seen in FIG. 4. The nozzles 16*c*, through which the cyan color ink is to be ejected, are located in the second leftmost one of the rows. The nozzles 16*y*, through which the yellow color ink is to be ejected, are located in the second rightmost one of the rows. The nozzles 16*m*, through which the magenta color ink is to be ejected, are located in the rightmost one of the rows. It is noted that a direction perpendicular to the rows (i.e., lateral direction as seen FIG. 4) corresponds to a direction in which the carriage 9 is movable (see FIG. 1).

Figure 3:
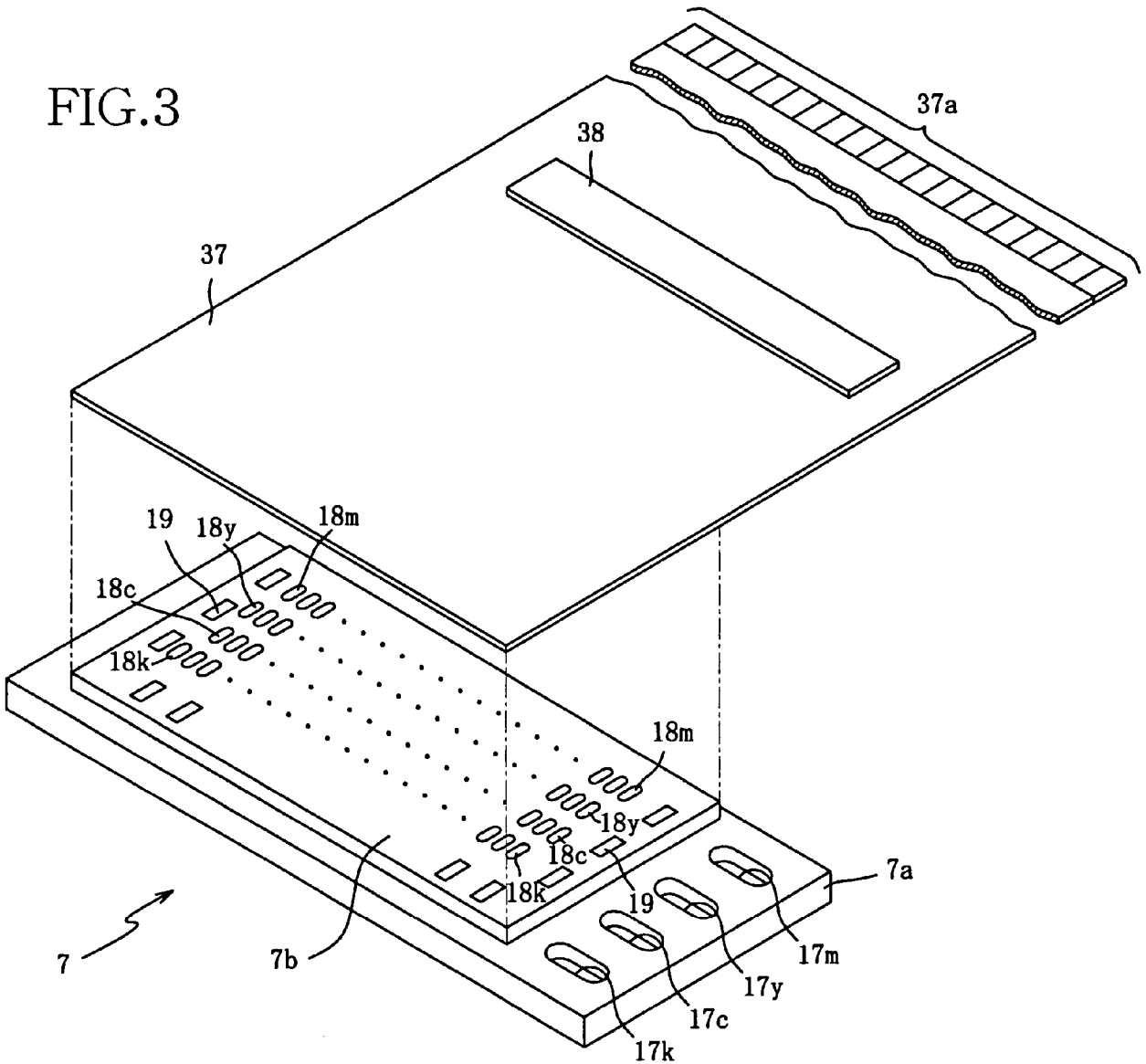
FIG. 3 is a perspective and exploded view of a recording head and a flexible wiring board of the inkjet recording apparatus of FIG. 1.

Like a recording head disclosed in JP-A-2002-234171, the recording head 7 includes a plate-type piezoelectric actuator unit 7*b* and a cavity unit 7*a* which is constituted by a plurality of plates which are superposed on each other. As shown in FIG. 3, the cavity unit 7*a* has ink inlets 17*k*, 17*c*, 17*y*, 17*m* which open in its upper surface. Each of the ink inlets 17*k*, 17*c*, 17*y*, 17*m* is held in communication with manifold passages, so that the ink of the corresponding color can be distributed into a plurality of pressure chambers via the respective manifold passages, and can be ejected through the nozzles 16*k*, 16*c*, 16*y*, 16*m* which are held in communication with the plurality of pressure chambers.

The piezoelectric actuator unit 7*b* has a plurality of pressure generators, i.e., recording elements each of which is piezoelectrically activatable or deformable to change a volume of a corresponding one of the pressure chambers. The actuator unit 7*b* further has drive electrodes 18*k*, 18*c*, 18*y*, 18*m* which are disposed on its upper surface and are connected to the respective recording elements, and a plurality of common electrodes 19 each of which is common to ones of the drive electrodes 18*k*, 18*c*, 18*y*, 18*m* as individual electrodes. The recording elements, whose number corresponds to that of the nozzles 16*k*, 16*c*, 16*y*, 16*m*, are arranged in the rows so as to correspond to the respective nozzles 16*k*, 16*c*, 16*y*, 16*m*. The drive signals are applied to selected ones of the drive electrodes 18*k*, 18*c*, 18*y*, 18*m*, whereby the recording elements corresponding to the selected drive electrodes 18*k*, 18*c*, 18*y*, 18*m* are activated or deformed to pressurize the inks within the corresponding pressure chambers, for ejecting the pressurized inks from the pressure chambers.

On the upper surface of the piezoelectric actuator unit 7*b* (i.e., the surface on which the drive electrodes are disposed), the flexible wiring board 37 is disposed so that an electric current can be supplied to each of the recording elements through the wiring pattern formed on the wiring board 37. The flexible wiring board 37 is elongated or extends in a direction substantially perpendicular to the rows of the drive electrodes 18*k*, 18*c*, 18*y*, 18*m* and the rows of the nozzles 16*k*, 16*c*, 16*y*, 16*m*, so that a widthwise direction of the flexible wiring board 37 substantially corresponds to a direction parallel with the rows of the drive electrodes 18*k*, 18*c*, 18*y*, 18*m* and the rows of the nozzles 16*k*, 16*c*, 16*y*, 16*m*, namely, substantially corresponds to a lengthwise direction of the recording head 7 rather than a widthwise direction of the recording head 7.

The flexible wiring board 37 has connection electrodes 52*k*, 52*c*, 52*y*, 52*m* each of which is formed thereon so as to be aligned or overlaps with a corresponding one of the drive electrodes 18*k*, 18*c*, 18*y*, 18*m* in a plan view of the wiring board 37 or recording head 7. The wiring board 37 further has common connection electrodes (not shown) formed thereon to be aligned or overlaps with a corresponding one of the common electrodes 19. A connection of each of the connection electrodes 52*k*, 52*c*, 52*y*, 52*m* with a corresponding one of the drive electrodes 18*k*, 18*c*, 18*y*, 18*m*, as well as a connection of each common connection electrode with the corresponding common electrode 19, is made by using an electrically conductive solder or adhesive.

The above-described wiring pattern formed on the flexible wiring pattern 37 is provided by a plurality of conductive lines or wires 51*k*, 51*c*, 51*y*, 51*m* each of which extends generally in the direction perpendicular to the rows of the connection electrodes 52*k*, 52*c*, 52*y*, 52*m* and each of which connects a corresponding one of the connection electrodes 52*k*, 52*c*, 52*y*, 52*m* to a corresponding one of output terminals 50 which are arranged in a row extending substantially in parallel with the rows of the connection electrodes 52*k*, 52*c*, 52*y*, 52*m*. It should be noted that each of the conductive wires 51*k*, 51*c*, 51*y* (connected to the connection electrodes 52*k*, 52*c*, 52*y* of three of the rows which are more distant from the converter 38 than the connection electrodes 52*m*) passes between adjacent connection electrodes of each row located between the converter 38 and the corresponding row of the connection electrodes 52 (to which the above-described each of the conductive wires 51*k*, 51*c*, 51*y* is connected), as shown in FIG. 5, such that the above-described each of the conductive wires 51*k*, 51*c*, 51*y* does not intersect with the other conductive wires.

The output terminals 50 arranged in the row can be grouped into a plurality of groups each constituted by adjacent ones of the output terminals 50. The number of the groups corresponds to the number of the connection electrodes 52 located in each of the rows, while the number of the adjacent ones of the output terminals 50 constituting each group is four, namely, corresponds to the number of the rows of the connection electrodes 52*k*, 52*c*, 52*y*, 52*m*. The adjacent output terminals 50 constituting each group are respectively connected to respective ones of the connection electrodes 52*k*, 52*c*, 52*y*, 52*m* which are located in the respective rows different from each other.

Figure 5:
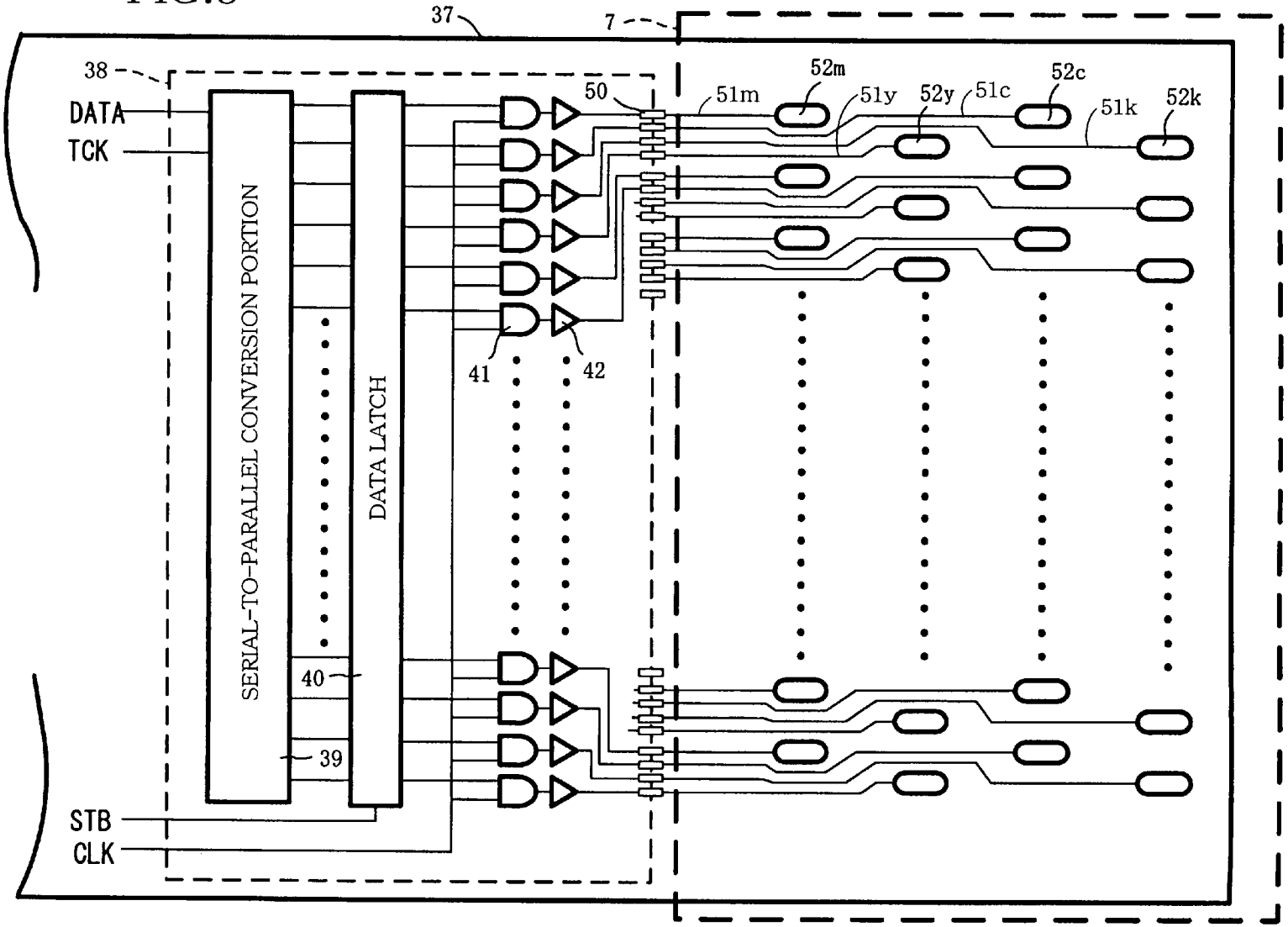
FIG. 5 is a plan view showing a wiring pattern and a converter which are provided on the flexible wiring board of FIG. 3.
Figure 6A:
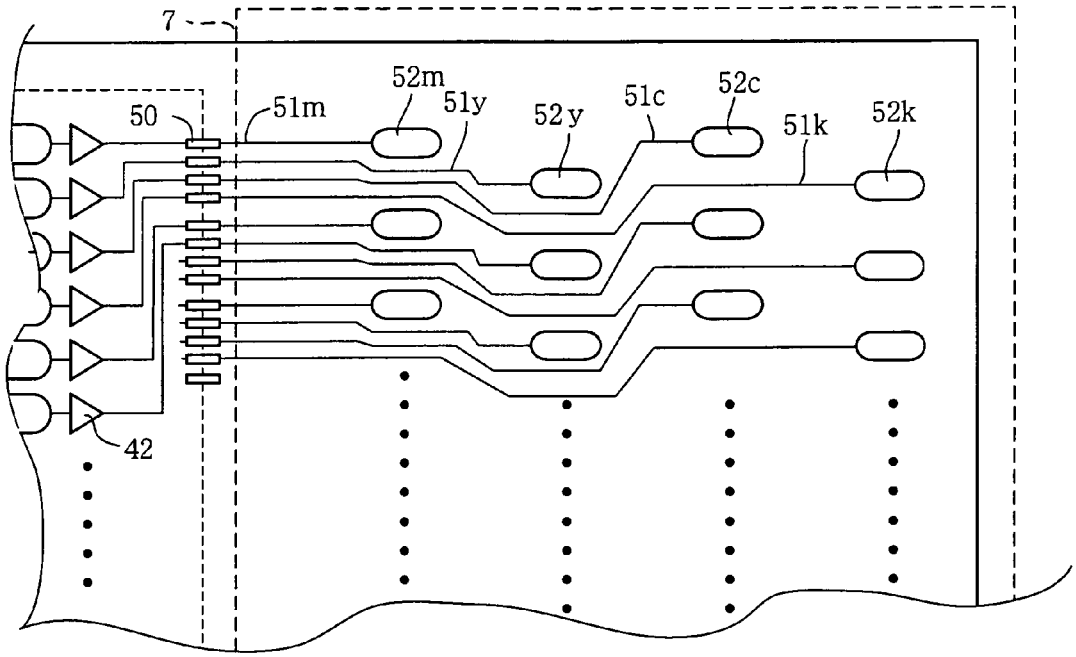
FIGS. 6A-6D are views showing some modifications to the wiring pattern of FIG. 5.
Figure 6B:
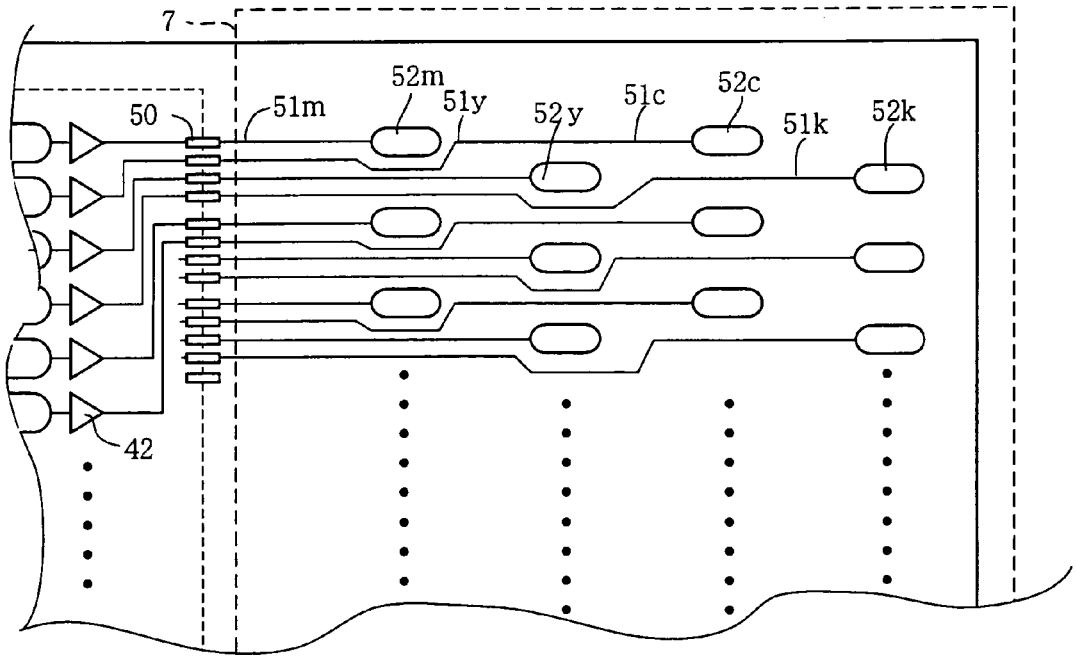
Figure 6C:
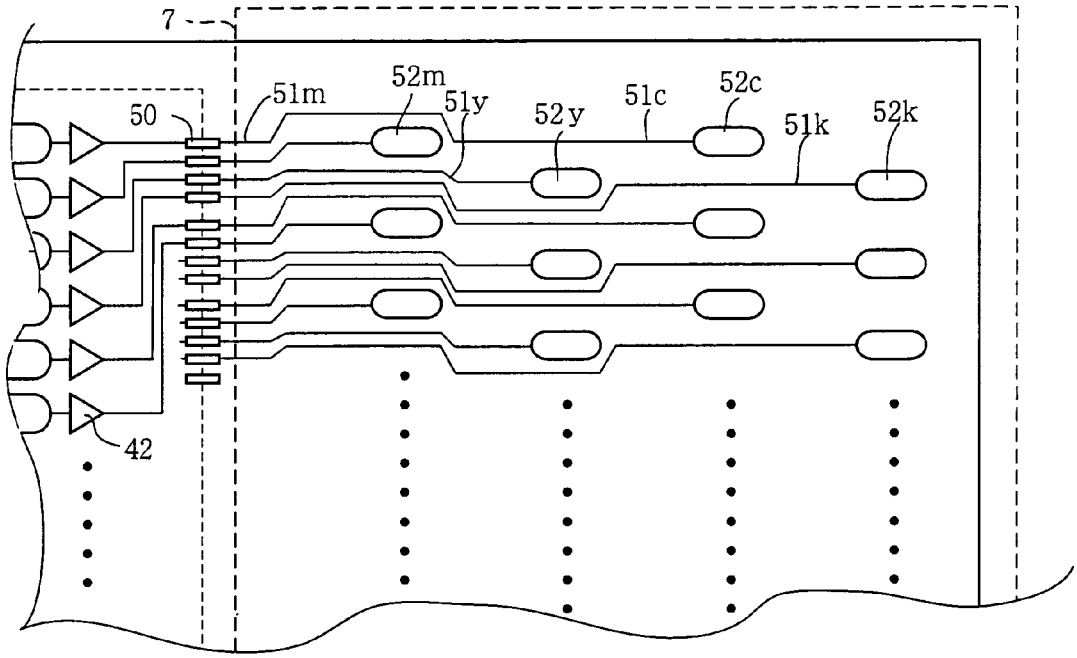
Figure 6D:
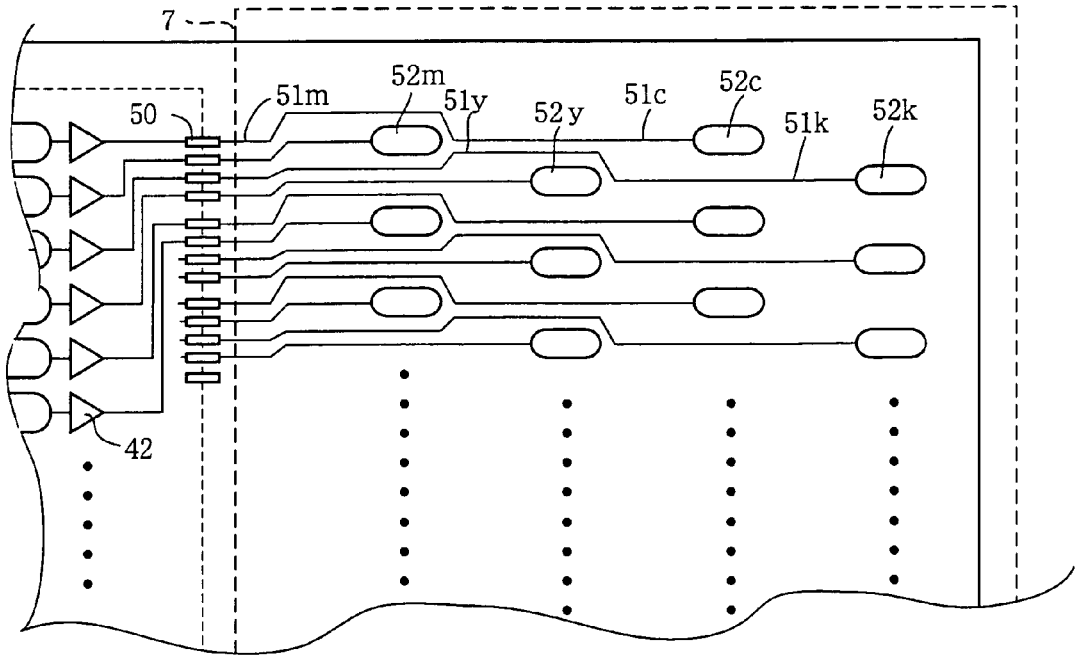

In the present embodiment, the uppermost one, the second uppermost one, the second lowermost one and the lowermost one of the adjacent output terminals 50 of the uppermost one of the groups are connected to the uppermost one of the connection electrodes 52*m*, the uppermost one of the connection electrodes 52*c*, the uppermost one of the connection electrodes 52*k* and the uppermost one of the connection electrodes 52*y*, respectively, as seen in FIG. 5. The uppermost one, the second uppermost one, the second lowermost one and the lowermost one of the adjacent output terminals 50 of the second uppermost group are connected to the second uppermost connection electrode 52*m*, the second uppermost connection electrode 52*c*, the second uppermost connection electrode 52*k* and the second uppermost connection electrode 52*y*, respectively. The output terminals 50 of each of the following groups are also connected to the respective connection electrodes 52*m*, 52*c*, 52*k* and 52*y*, in this order of description. That is, where the connection electrodes of each electrode row are sequentially given numbers 1, 2, 3, 4, . . . 75, from the upper end to the lower end of the electrode row, the output terminals 50 respectively connected to the connection electrodes $52m_1$, $52c_1$, $52k_1$, $52y_1$, $52m_2$, $52c_2$, $52k_2$, $52y_2$, . . . $52m_{75}$, $52c_{75}$, $52k_{75}$, $52y_{75}$ are arranged in this order of description as viewed in a direction from the upper end to the lower end of the output terminal row.

In other words, the output terminals 50 are arranged in the output terminal row from a first group to a last group while the connection electrodes 52 are arranged from a first one to a last one in each of the plurality of electrode rows as counted from one end of the recording head 7 to the other end of the recording head 7. The adjacent output terminals 50 constituting the first group are connected to respective first ones of the connection electrodes 52 in a predetermined connecting order, on the basis of which one of the adjacent output terminals 50 is connected to each of the respective first ones of the connection electrodes 52. The output terminals 50 of each of the following groups (second group to last group) are also connected to the respective connection electrodes 52, in this predetermined connecting order.

As described above, the output terminals 50 are connected to the respective connection electrodes 52 across the plurality of rows of the connection electrodes 52, and are arranged in the row in an order corresponding to the order of the arrangement of the connection electrodes 52 from the above-described one end of the recording head 7 to the other end of the recording head 7. However, the order of the arrangement of the output terminals 50 in the row does not have to necessarily correspond to the order of the arrangement of the connection electrodes 52, as long as the conductive wires 51*k*, 51*c*, 51*y*, 51*m* do not intersect with each other, or do not overlap with each other in a plan view of the wiring board 37 or recording head 7. That is, each one of the output terminals 50 may be connected to one of the connection electrodes 52, such that a position of each output terminal 50 relative to the other output terminals 50 as viewed in a direction parallel with the output terminal row substantially corresponds to a position of the above-described one of the connection electrodes 52 relative to the other connection electrodes 52 as viewed in a direction parallel with the electrode rows.

The output terminals 50 can be categorized into a plurality of families each constituted by ones of the output terminals 50 which are connected to respective ones of the connection electrodes 52 located in a corresponding one of the electrode rows. In this case, the arrangement of the output terminals 50 in the terminal row may be defined by a definition that each family of the output terminals 50 are arranged in an order of arrangement of ones of the connection electrodes 52 which are located in a corresponding one of the electrode rows and which are connected to the above-described each family of the output terminals 50.

The converter 38 includes a serial-to-parallel conversion portion 39 provided by a shift register, a data latch 40, gate circuits 41 and output portions 42. The recording data DATA is serially transmitted, together with the transfer clock TCK, from the controller 26*a*, and is sequentially stored into the serial-to-parallel conversion portion 39, so as to be converted into parallel data signals, which are then outputted into the data latch 40. Each of the parallel data signals is outputted in response to the strobe signal STB, into a corresponding one of the gate circuits 41. Each parallel data signal is outputted in accordance with the ejection timing signal CLK, to the corresponding connection electrode 52, i.e., to the corresponding drive electrode 18. In this instance, the output portion 42 forms a drive signal based on the transmitted parallel data signal, such that the drive signal has predetermined amounts of electric current and voltage which are suitable for driving the recording element.

Each of the serial-to-parallel conversion portion 39 and the data latch 40 has a number of bits corresponding to a number of all the drive electrodes 18 of the recording head 7. A number of the gate circuits 41 and a number of the output portions 42 correspond to the number of all the drive electrodes 18.

Next, there will be described controls achieved by the controller 26*a* and the converter 38 to perform a recording operation onto the recording medium 6 in the inkjet printer 1 which is constructed as described above.

In response to command from the CPU 22 requesting a recording operation based on predetermined recording information, the predetermined recording information is temporarily stored into the buffer section of the image memory 25 such that each portion of the recording information related to a corresponding one of the recording ink colors is stored into a corresponding one of the black-color-image-data buffer storage 25*k*, cyan-color-image-data buffer storage 25*c*, yellow-color-image-data buffer storage 25*y* and magenta-color-image-data buffer storage 25*m*. The controller 26*a* of the G/A 26 reads out the recording information from the buffer storages 25*m*, 25*c*, 25*k*, 25*y* in an order corresponding to the arrangement of the output terminals 50 in which those respectively connected to the connection electrodes 52$m_1$, 52$c_1$, 52$k_1$, 52$y_1$, 52$m_2$, 52$c_2$, 52$k_2$, 52$y_2$, . . . 52$m_{75}$, 52$c_{75}$, 52$k_{75}$, 52$y_{75}$ are arranged in this order of description, and serially transmits the recording information to the converter 38 via the signal line (labeled "DATA" in FIG. 5). That is, the controller 26*a* forms the data DATA which is representative of the recording information and which includes a plurality of data segments or elements each related to a corresponding one of the recording elements or connection electrodes 52 such that the plurality of data elements arranged in the order corresponding to the arrangement of the output terminals 50, so as to sequentially transmit the data elements to the converter 38 in the order corresponding to the arrangement of the output terminals 50.

The converter 38 converts the serially transmitted data DATA into parallel transmitted data corresponding to the connection electrodes 52$m_1$, 52$c_1$, 52$k_1$, 52$y_1$, 52$m_2$, 52$c_2$, 52$k_2$, 52$y_2$, . . . 52$m_{75}$, 52$c_{75}$, 52$k_{75}$, 52$y_{75}$, and forms the drive signals based on the parallel transmitted data such that each drive signal has a predetermined amount of voltage. The drive signals outputted from the output portions 42 of the converter 38 are supplied to the respective connection electrodes 52*k*, 52*c*, 52*y*, 52*m* and drive electrodes 18*k*, 18*c*, 18*y*, 18*m* via the respective conductive wires 51*k*, 51*c*, 51*y*, 51*m*. As a result of application of the drive signals to the drive electrodes 18*k*, 18*c*, 18*y*, 18*m*, the recording elements are activated to eject the inks through the nozzles 16*k*, 16*c*, 16*y*, 16*m*, whereby the predetermined recording information is recorded onto the recording medium 6.

As described above, in the inkjet printer 1 constructed according to the embodiment of the invention, the flexible wiring board 37 is connected to the recording head 7 and extends from the recording head 7 in the direction substantially perpendicular to the rows in which the recording elements are arranged. In a recording operation with this inkjet printer 1, the recording information is read out from the buffer storages 25*m*, 25*c*, 25*k*, 25*y* which store the respective portions of the recording information related to the respective recording ink colors, in the order generally corresponding to the arrangement of the recording elements from the one end of the recording head 7 to the other end thereof. That is, the data elements are sequentially transmitted in such an order that permits the color-basis sectioned portions of the recording information (related to the respective different recording ink colors) to be intermingled with each other rather than to be separated from each other. The serially transmitted data is converted into the parallel signals serving as the drive signals for driving the respective recording elements. Therefore, in the inkjet printer 1, a full-color printing operation can be realized by a simple wire or circuit arrangement. Further, in the inkjet printer 1, although the flexible wiring board 37 extends from the recording head 7 in the direction substantially perpendicular to the rows of the recording elements, the recording elements can be controlled without complicating the wire or circuit arrangement, namely, with the wire or circuit arrangement which can be established at a reduced cost.

Further, in the present inkjet printer 1 in which the flexible wiring board 37 is elongated in the direction substantially perpendicular to the rows of the drive electrodes 18*k*, 18*c*, 18*y*, 18*m*, the wiring board 37 can be given a width as large as the lengthwise dimension of the recording head 7 as measured in the direction parallel with the rows of the drive electrodes 18*k*, 18*c*, 18*y*, 18*m*, it is possible to form, on the wiring board 37, a large number of the conductive wires 51 which are required for large numbers of the recording elements and the drive electrodes 18. Further, since the wiring pattern and the converter 38 are disposed on the wiring board 37, the converter 38 can be easily attached to the wiring board 37, and the wiring board 37 can be easily attached to the carriage board 21 and the recording head 7.

Further, in the present inkjet printer 1, since the output terminals 50 of all the groups are connected to the respective connection electrodes 52*m*, 52*c*, 52*k* and 52*y*, in the same order, as shown in FIG. 5, the generation of the serial signal in the controller 26*a* and the conversion of the serial signal into the parallel signals in the converter 38 can be easily made.

Further, in the present inkjet printer 1, the converter 38 includes the serial-to-parallel conversion portion 39 which converts the serially transmitted data into the parallel transmitted data, and the output portion 42 which forms the drive signals based on the serially transmitted data so as to output the formed drive signals. This arrangement enables the recording information to be transmitted with a relatively low voltage level through a relatively small number of conductive wires, and enables each parallel signal whose voltage level is suitable for driving the recording elements to be outputted from the output portion 42, thereby making it possible to efficiently drive the large number of recording elements.

Further, in the present inkjet printer 1, since the controller 26*a* is disposed on the main control board 20 (provided in main body of the inkjet printer 1) rather than on the recording head 7, the recording head 7 can be made compact in size.

While a preferred embodiment of this invention has been described above, it is to be understood that the invention is not limited to the details of the illustrated embodiment, but may be embodied with various changes and modifications, which may occur to those skilled in the art, without departing from the sprit and scope of the present invention.

For example, in the illustrated embodiment, the image memory 25 is provided with the image-data buffer storages 25*k*, 25*c*, 25*y*, 25*m* storing the respective portions of the recording information which are related to the respective different recording ink colors in the illustrated embodiment. However, the provision of the image-data buffer storages 25*k*, 25*c*, 25*y*, 25*m* is not essential. The controller 26*a* may be arranged to read out from the image memory 25, in response to the recording-operation requesting command from the CPU 22, the recording information in the order corresponding to the arrangement of the output terminals 50, and serially transmit the recording information in the same order. Further, the recording information may be read out and serially transmitted in the order corresponding to the arrangement of the output terminals 50, by a control routine executed by the CPU 22 according to a software program.

In the illustrated embodiment, the output terminals 50 of all the groups are connected to the respective connection electrodes 52*m*, 52*c*, 52*k* and 52*y*, in this order of description (predetermined based on which of the output terminals 50 of each group is connected to which of the respective connection electrodes 52*m*, 52*c*, 52*k*, 52*y*), as shown in FIG. 5. However, the wiring pattern of FIG. 5 may be modified such that the four output terminals 50 of each group are connected to the respective connection electrodes 52 in any one of different connecting orders whose number is 24, which corresponds to permutation ${}_4P_4$(=4!=4×3×2×1). The above-described order of description is merely one of the 24 different connecting orders. FIGS. 6A-6D show other four of the 24 different connecting orders.

Further, the groups of the output terminals 50 do not have to be identical with each other with respect to the connecting order, but may be different from each other, depending upon the order of the serial transmission of the recording information by the controller 26*a* to the converter 38.

While the number of the rows of the recording elements is four in the illustrated embodiment, it may be changed as needed. Further, depending upon amount of the consume of each color ink, the number of the row assigned to each color ink may be suitably changed. Further, the present invention is applicable not only to an inkjet recording apparatus but also to any other recoding apparatus equipped with a recording head having recording elements arranged in a plurality of rows.

What is claimed is:

1. A recording apparatus for performing a recording operation on a recording medium on the basis of recording information, such that the recording operation is performed with a plurality of recording colors, said recording apparatus comprising:

a recording head having (i) recording elements which are arranged in a plurality of rows, and (ii) drive electrodes which are arranged in a plurality of rows and which receive respective drive signals to drive the respective recording elements;

information storages each storing a portion of said recording information which is related to a corresponding one of the recording colors;

a converter which converts serially transmitted data representative of said recording information, into parallel signals serving as said drive signals applied to said drive electrodes; and a controller which reads out said recording information from said information storages and which transmits said data serially to said converter;

wherein said plurality of rows of said drive electrodes are associated with the respective recording colors, wherein said serially transmitted data includes a plurality of data elements each related to a corresponding one of said recording elements, wherein said converter has a plurality of output terminals which are connected to the respective drive electrodes across said plurality of rows of said drive electrodes, and are arranged in a row in an order generally corresponding to arrangement of said drive electrodes from one end of said recording head to the other end thereof, wherein said controller transmits said data representative of said recording information to said converter serially in association with said drive electrodes, in an order corresponding to arrangement of said output terminals, wherein said controller reads out said recording information from said information storages in said order corresponding to said arrangement of said output terminals, and wherein said controller forms said serially transmitted data representative of said recording information such that said plurality of data elements of said data are arranged in said order corresponding to said arrangement of said output terminals, so as to transmit said plurality of data elements to said converter in said order corresponding to said arrangement of said output terminals.

2. The recording apparatus according to claim 1, wherein said row of said output terminals as a terminal row and each of said rows of said drive electrodes as electrode rows linearly extend, and are parallel to each other.

3. The recording apparatus according to claim 2, wherein each one of said plurality of output terminals is connected to one of said drive electrodes, such that a position of said each one of said output terminals relative to others of said output terminals as viewed in a direction parallel with said terminal row substantially corresponds to a position of said one of said drive electrodes relative to others of said drive electrodes as viewed in a direction parallel with said electrode rows.

4. The recording apparatus according to claim 1, wherein said plurality of output terminals arranged in said row are grouped into a plurality of groups each constituted by adjacent ones of said output terminals, wherein said adjacent ones of said output terminals constituting each of said groups corresponds in number to said plurality of rows of said drive electrodes, and wherein said adjacent ones of said output terminals constituting each of said groups are respectively connected to respective ones of said drive electrodes which are located in the respective rows different from each other.

5. The recording apparatus according to claim 4, wherein said plurality of output terminals are arranged in said row from a first group to a last group while said drive electrodes are arranged from a first one to a last one in each of said plurality of rows of said drive electrodes as counted from said one end of said recording head to the other end thereof, wherein said adjacent ones of said output terminals constituting the first group are connected to respective first ones of said drive electrodes in a predetermined connecting order, based on which of said adjacent ones of said output terminals is connected to which of said respective first ones, and wherein a second group to the last group of said output terminals are connected to respective second ones to last respective ones of said drive electrodes in said predetermined connecting order.

6. The recording apparatus according to claim 1, wherein said plurality of output terminals are categorized into a plurality of families each constituted by ones of said output terminals which are connected to respective ones of said drive electrodes located in a corresponding one of said plurality of rows, wherein said plurality of output terminals are arranged such that each family of said output terminals are arranged in an order of arrangement of ones of said drive electrodes which are located in a corresponding one of said plurality of rows and which are connected to said each family of said output terminals.

7. The recording apparatus according to claim 1, wherein each adjacent pair of said output terminals, which are adjacent to each other, are respectively connected to two of said drive electrodes which are located in respective two of said plurality of rows.

8. The recording apparatus according to claim 1, further comprising a wiring board which is elongated in a direction substantially perpendicular to said rows of said drive electrodes and which has a wiring pattern connecting said plurality of output terminals to said respective drive electrodes, wherein said converter having said plurality of output terminals is disposed on said wiring board.

9. The recording apparatus according to claim 8, wherein said wiring pattern is provided by a plurality of conductive wires each connecting a corresponding one of said output terminals to a corresponding one of said drive electrodes, and wherein said conductive wires are arranged so as not to overlap with each other in a plan view of said wiring board.

10. The recording apparatus according to claim 8, further comprising a relay circuit board which is disposed on a carriage carrying said recording head and which is connected to a controller board which is provided in a main body of said recording apparatus, wherein said controller is disposed on said controller board, and wherein said wiring board is provided by a flexible board which connects said relay circuit board to said recording head.

11. The recording apparatus according to claim 1, wherein said converter includes (i) a serial-to-parallel conversion portion which converts said serially transmitted data into parallel transmitted data, and (ii) an output portion which forms said drive signals based on said serially transmitted data so as to output the formed drive signals.

* * * * *